US007255293B2

(12) United States Patent
Dodd

(10) Patent No.: US 7,255,293 B2
(45) Date of Patent: Aug. 14, 2007

(54) HOSE-END SPRAYER ASSEMBLY

(75) Inventor: Joseph K. Dodd, Lee's Summit, MO (US)

(73) Assignee: MeadWestvaco Corporation, Glen Allen, VA (US)

( * ) Notice: Subject to any disclaimer, the term of this patent is extended or adjusted under 35 U.S.C. 154(b) by 0 days.

(21) Appl. No.: 10/777,076

(22) Filed: Feb. 13, 2004

(65) Prior Publication Data

US 2005/0178854 A1 Aug. 18, 2005

(51) Int. Cl.
*A62C 5/02* (2006.01)

(52) U.S. Cl. ..... 239/310; 239/347; 239/574; 137/588

(58) Field of Classification Search ..... 239/310–318, 239/101, 347, 348, 353, 354, 574; 137/588
See application file for complete search history.

(56) References Cited

U.S. PATENT DOCUMENTS

| | | | | | |
|---|---|---|---|---|---|
| 1,071,432 | A | | 8/1913 | Kelley | 137/255 |
| 2,612,403 | A | | 9/1952 | Burch | 239/318 |
| 2,761,734 | A | | 9/1956 | Farmer | 239/318 |
| 3,034,731 | A | | 5/1962 | Chapin | 239/318 |
| 3,186,643 | A | | 6/1965 | George et al. | 293/318 |
| 3,201,049 | A | | 8/1965 | Hayes | 239/433 |
| 3,204,875 | A | | 9/1965 | Langstroth | 239/433 |
| 3,212,716 | A | | 10/1965 | Mills et al. | 239/318 |
| 3,255,972 | A | | 6/1966 | Hultgren, Jr. et al. | 239/433 |
| 3,333,601 | A | | 8/1967 | Lofgreen | 137/636.1 |
| 3,610,535 | A | | 10/1971 | Bradshaw | 239/305 |
| 3,964,689 | A | | 6/1976 | Horvath, Jr. et al. | 239/433 |
| 4,171,070 | A | * | 10/1979 | Colgate et al. | 222/133 |
| 4,315,601 | A | | 2/1982 | Brooker | 239/142 |
| 4,349,157 | A | | 9/1982 | Beiswenger et al. | 239/509 |
| 4,369,921 | A | | 1/1983 | Beiswenger et al. | 239/318 |
| 4,475,689 | A | | 10/1984 | Hauger et al. | 239/318 |
| 4,508,272 | A | | 4/1985 | Thompson | 239/318 |
| 4,527,740 | A | | 7/1985 | Gunzel, Jr. et al. | 239/318 |
| 4,595,127 | A | * | 6/1986 | Stoody | 222/135 |
| 4,736,891 | A | | 4/1988 | Chow et al. | 239/318 |
| 4,750,674 | A | | 6/1988 | Chow et al. | 239/318 |
| 4,901,923 | A | | 2/1990 | McRoskey et al. | 239/123 |
| 5,039,016 | A | | 8/1991 | Gunzel et al. | 239/314 |
| 5,100,059 | A | | 3/1992 | Englehard et al. | 239/310 |
| 5,213,264 | A | | 5/1993 | Styne | 239/309 |
| 5,213,265 | A | | 5/1993 | Englehard et al. | 239/310 |
| 5,320,288 | A | | 6/1994 | Ketcham et al. | 239/316 |
| 5,356,076 | A | * | 10/1994 | Bishop | 239/311 |
| 5,372,310 | A | | 12/1994 | Ketcham | 239/317 |
| 5,383,603 | A | | 1/1995 | Englehard et al. | 239/314 |

(Continued)

*Primary Examiner*—Christopher Kim
(74) *Attorney, Agent, or Firm*—Gordon & Jacobson, PC

(57) ABSTRACT

A sprayer assembly for connection to a container of liquid chemical to be sprayed has a manually operable rotary valve mounted within the housing of the assembly and has a carrier liquid duct and a product duct opening into the liquid duct, the valve being selectively rotatable to an ON position in which the carrier liquid inlet passage is connected with the liquid product inlet opening, and the valve being selectively rotatable to an OFF position in which the carrier liquid passage is not connected with the liquid product inlet opening, the housing have a vent port, and an external vent control member mounted on the housing for movement by the valve to close the vent port in the OFF position and to open the vent port in the ON position.

23 Claims, 2 Drawing Sheets

U.S. PATENT DOCUMENTS

| | | | | |
|---|---|---|---|---|
| 5,626,291 | A | 5/1997 | Flinn et al. | 239/310 |
| 5,881,955 | A | 3/1999 | Styne | 239/310 |
| 5,954,272 | A | 9/1999 | Liao | 239/317 |
| 5,954,273 | A | 9/1999 | Ruta et al. | 239/419.3 |
| 6,053,374 | A | 4/2000 | Santagiuliana | 222/534 |
| 6,267,303 | B1 | 7/2001 | Francis | 239/318 |
| 6,283,385 | B1 | 9/2001 | Beaver et al. | 239/10 |
| 6,378,785 | B1 | 4/2002 | Dodd | 239/318 |
| 6,425,534 | B2 | 7/2002 | Ketcham et al. | 239/316 |
| 6,471,141 | B2 | 10/2002 | Smith et al. | 239/10 |
| 6,578,776 | B1 | 6/2003 | Shanklin et al. | 238/318 |
| 6,672,520 | B2 | 1/2004 | Shanklin et al. | 239/318 |
| 6,772,966 | B2 | 8/2004 | Foster et al. | 239/581.2 |
| 2005/0098656 | A1 | 5/2005 | Dodd | 239/318 |

* cited by examiner

HOSE-END SPRAYER ASSEMBLY

BACKGROUND OF THE INVENTION

This invention relates generally to a sprayer assembly adapted to be connected to a source of pressurized carrier liquid, and is adapted to be mounted to a container of chemical liquid to be siphoned into the stream of carrier liquid in a valve open position.

There are a variety of sprayer assemblies arranged to be mounted on a container of liquid chemical and coupled to the end of a hose for drawing an amount of the liquid chemical into the water path through a venturi effect or by the provision of an air gap. A rotatable valve, manually operable, is designed to turn the sprayer on as the carrier liquid inlet and the product inlet are connected, to turn the sprayer off by disconnecting the product inlet and carrier liquid inlet, and to provide for rinsing in which the carrier liquid passage is connected to discharge.

It is important to vent the container to atmosphere in the ON position of the sprayer while chemical liquid product is being drawn into the liquid carrier stream.

The vent control is on the rotary valve within valve chamber of the sprayer housing in accordance with U.S. Pat. Nos. 6,578,776 and 6,672,520 which, as pointed out in the aforenoted related application 60/515,416, allows for unwanted seepage of carrier liquid into the chemical container during the vent open position which is, of course, most undesirable. If such seepage is allowed to persist the liquid chemical will become so diluted that it could lose its effectiveness when spraying garden shrubs and the lawn with a selected chemical. The invention set forth in the aforenoted related application solves this problem by isolating the carrier liquid/chemical liquid connection from the vent and vent control, thereby avoiding the aforementioned dilution problem.

It would be desirable to provide another solution to venting of simple construction which is easy to use and assemble yet highly effective in providing for reliable vent control. And avoids any possibility of seepage of carrier liquid into the container in a vent open condition.

SUMMARY OF THE INVENTION

It is therefore an object of the present invention to provide a hose-end sprayer assembly having a rotary valve which connects a carrier liquid inlet passage with a liquid product inlet opening in an ON position of the sprayer and which simultaneously opens a vent located on the sprayer housing. An external vent control member is mounted on the housing and is engageable by the valve to open and close the vent respectively during the ON and OFF positions of the valve. The external vent control may comprise a rocker arm having a vent seal for movement into and out of a vent path, and a cam surface or the like for engagement by a projection on the valve during its rotary movement to effect rocking between vent ON and OFF positions.

Other objects and variations are made possible in accordance with the invention when taken in conjunction with the accompanying drawings.

DETAILED DESCRIPTION OF THE INVENTION

Figure 1:
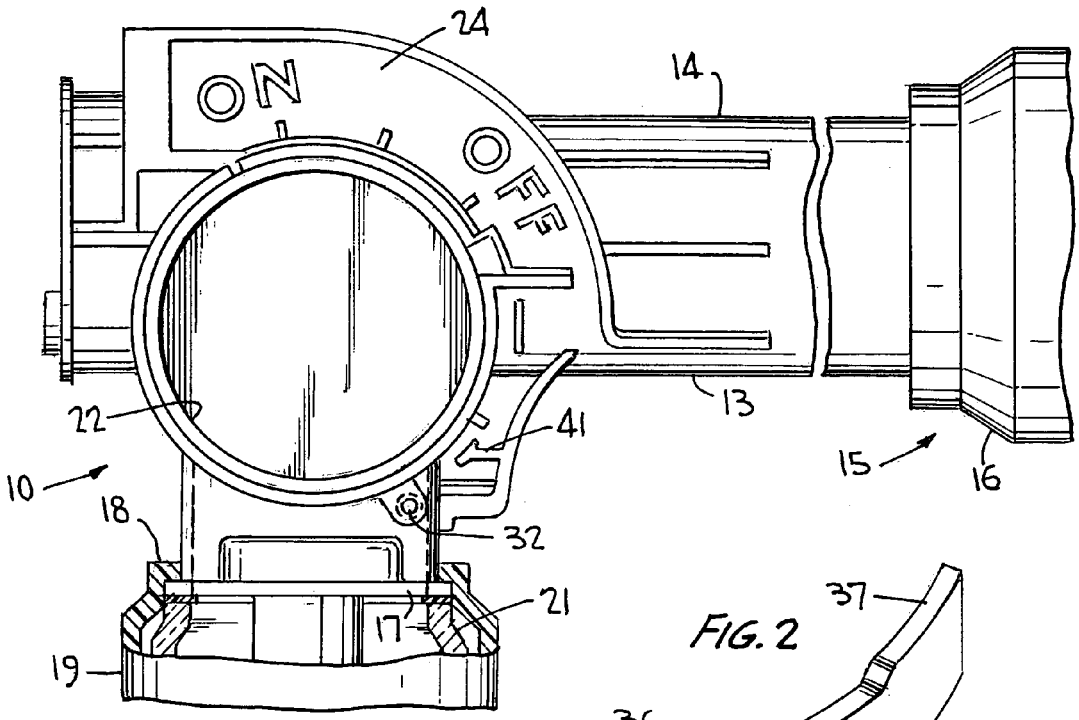
FIG. 1 is a side elevational view of the sprayer assembly according to the invention, the rotary valve and the vent control not being shown for the sake of clarity.
Figure 2:
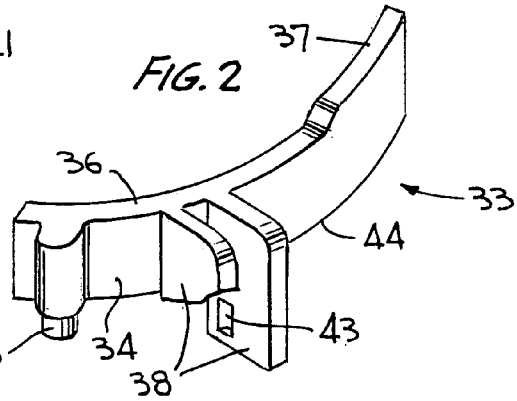
FIG. 2 is a perspective view, partly broken away, of the vent control member which is part of the sprayer assembly according to the invention.
Figure 3:
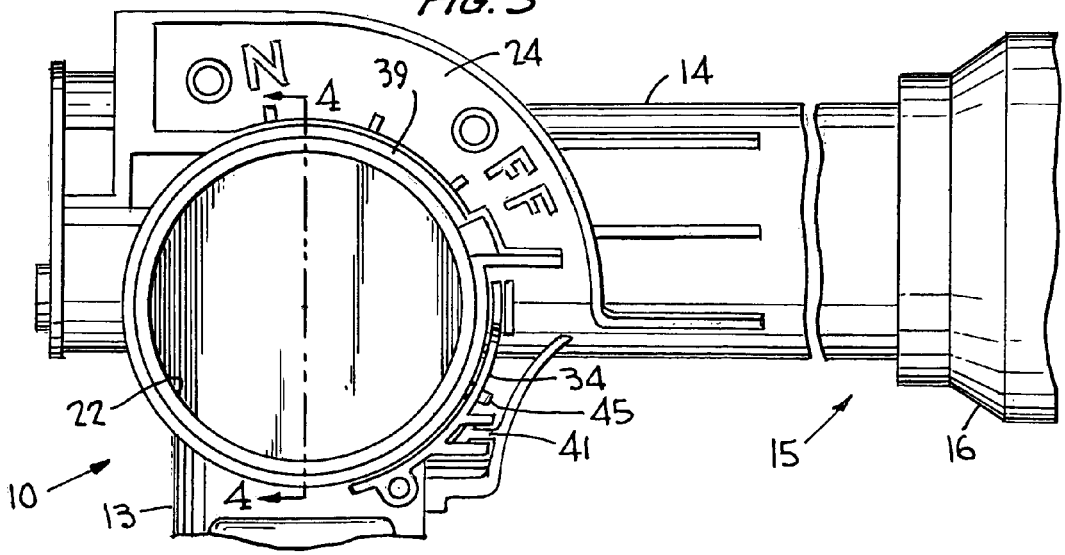
FIG. 3 is a view similar to FIG. 1, with the vent control member mounted in place on the housing of the assembly.

Turning now to the drawings wherein like reference characters refer to like and corresponding parts throughout the several views, the sprayer assembly according to the invention is generally designated 10 in FIGS. 1, 3, 5 and 6, although in FIGS. 1 and 3, rotary valve 11 (FIGS. 5, 6) is not shown for the sake of clarity, and vent control member 12 (FIG. 2) is not shown for the sake of clarity in FIG. 1.

The sprayer assembly includes a housing 13 similar to that shown in U.S. Pat. No. 6,378,785, commonly owned herewith, the entirety of which is incorporated herein by reference. The housing includes a conduit 14 having an anti-siphon assembly 15 at its free end which includes a closure 16 for mounting assembly 10 to the end of a garden hose (not shown) or the like. The housing further includes an end collar 17 engageable by an annular lip 18 on container closure 19 for supporting the sprayer assembly on neck 21 of a container (not otherwise shown).

Figure 4:
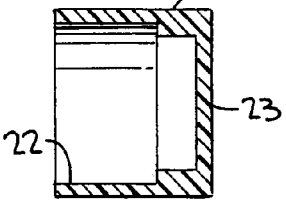
FIG. 4 is a sectional view, at a reduced scale, taken substantially along the line 4-4 of FIG. 3.

The sprayer housing further includes a transverse bore 22 (FIG. 4) which may or may not have a back wall 23. And, the housing may have an arcuate shaped wall 24 containing indicia such as ON and OFF as shown to assist the user in determining the ON and OFF positions of the valve as will be further explained hereinafter.

Figure 5:
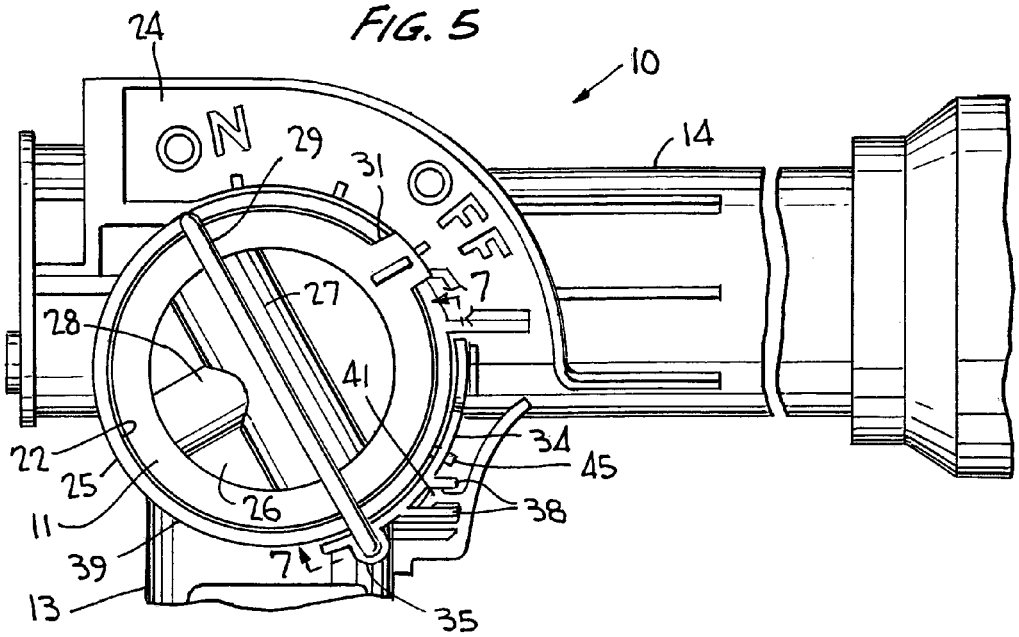
FIG. 5 is a view similar to FIG. 3 showing the rotary valve installed with the sprayer assembly and rotated to the sprayer OFF position at which the vent is closed.
Figure 6:
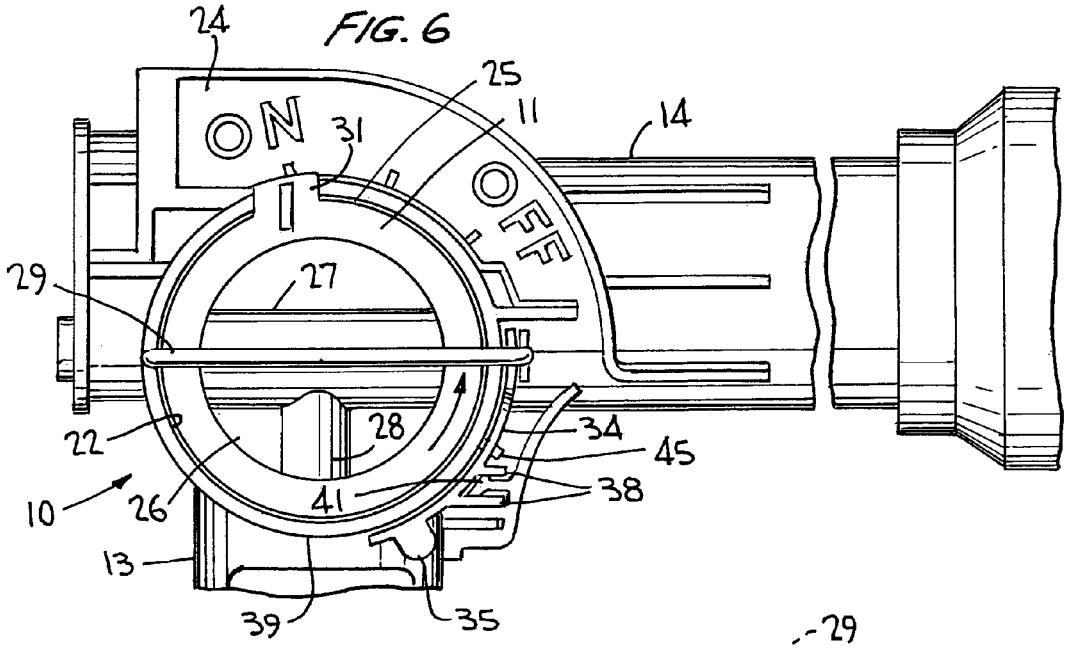
FIG. 6 is a view similar to FIG. 5 showing the rotary valve rotated to its ON position with the vent open.

The sprayer housing as aforedescribed is essentially the same as that disclosed in the U.S. Pat. No. 6,378,785. And, rotary valve 11 is likewise essentially the same as disclosed therein. The rotary valve is shown assembled in place in FIGS. 5, 6, and comprises a cylindrical outer wall 25 that may be closed at one end as at 26. The valve has a carrier liquid duct 27 extending along the diameter of the cylindrical valve, and a radially extending chemical liquid inlet duct 28 in open communication with duct 34. The rotary valve likewise has a turning handle 29 or the like to be grasped by the operator for rotating the valve about is central axis, and an indicator bar 31 or the like extending radially outwardly and which may partially underlie wall 24 when the rotary valve is assembled in place as shown in FIGS. 5 and 6.

The rotary valve is manually rotatable between its ON and OFF positions. In the ON position, shown in FIG. 6, water under pressure from the open garden hose passes through an inlet passage located within conduit 14 and through carrier liquid duct 27 which, as disclosed in the commonly owned application No. 60/515,416, the entire disclosure of which is incorporated specifically herein by reference, includes a Venturi section formed as a gradually reducing inner diameter so as to constrict the flow of the carrier fluid in the ON position of the rotary valve during its movement therealong. The inlet duct likewise has a tube section of essentially constant diameter larger than the smallest diameter of the Venturi section. At a junction between such sections an inlet duct or port (not shown) from the housing is in communication therewith. Such a duct or port, as shown in U.S. Pat. No. 6,378,785, communicates with the dip tube extending into the container. Therefore, as the carrier liquid flows along the Venturi section the carrier fluid pressure drops thereby suctioning chemical product up the dip tube and through the product inlet duct/port into the carrier stream. Chemical product aspirated into the carrier stream thus mixes therewith and is discharged through the open end of the discharge passage (shown in U.S. Pat. No. 6,378,785) located in the housing in horizontal alignment with duct 27 in the FIG. 6 position. A rotatable nozzle (not shown) may be provided at the forward end of the sprayer assembly for directing the flow of mixed liquid toward the target. Thus, the rotary valve is selectively rotatable within its bore for interconnecting the carrier liquid inlet passage within conduit 14 and the liquid product inlet port located in the housing with the discharge passage located in the housing in the ON position of FIG. 6. And, the valve is selectively rotatable to its OFF position of FIG. 5 in which the carrier liquid inlet passage is not connected with the liquid product inlet port. Again, the details of such selective ON/OFF positioning of the rotary valve is described in detail in the U.S. Pat. No. 6,378,785 and in the 60/515,416 application. Further detailed description thereof will therefore not be set forth herein.

In accordance with the invention, container venting is provided such that a vent port 32 (FIGS. 1 and 7) provided in the housing communications directly with the interior of the container and is open to atmosphere. The vent control according to the invention is external to the rotary valve and its transverse bore by the provision of a control member 33, shown in detail in FIG. 2, which may be in the form of an arcuate rocker arm 34 having a vent plug seal 35 at one end. And, the rocker arm at its outer edge 36 may have a cam surface 37 formed near its opposite end.

Between its ends the rocker arm may have a pair of outwardly extending, spaced mounting flanges 38 for mounting the arcuate rocker arm to the outside of the housing parallel to transverse cylindrical wall 39 thereof which forms the transverse bore 22 receiving the rotary valve. And, the housing may have a projection 41 with a barbed outer end which, in the assembled position of the vent control member of FIGS. 5 and 6, and as shown in detail in FIG. 7, extends between flanges 38 such that its barbs 42 extend within detents 43 at the inner walls of flanges 38 to facilitate a quick and simple yet secure snap fitting of the arcuate rocker arm in place during assembly. In such a position, plug seal 35 is arranged such as to be coaxial with vent port 32 (FIG. 7) And, when mounted in place, inner edge 44 of the rocker arm bears against a pivot pin 45 which extends radially outwardly from cylindrical wall 39 of the housing.

Figure 7:
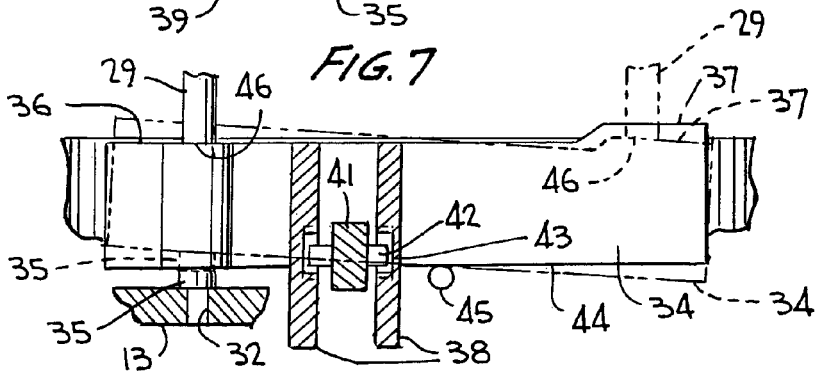
FIG. 7 is a view, at an enlarged scale and partly in section, taken substantially along the line 7-7 of FIG. 5.

In operation, with the valve rotated to its ON position of FIG. 6, underside 46 of handle 29, which extends radially outwardly of cylindrical wall 39 of the housing, bears against cam surface 37, as illustrated in phantom outline in FIG. 7, causing rocker arm 44 of the vent control member to pivot about pivot pin 45 causing that end to move downwardly and its opposite to move in an upward direction whereupon vent plug seal 35 moves away from vent port 32 to thereby open the vent. Thus, in the ON position of the valve, the vent which communicates with the interior of the container is open to atmosphere permitting product being drawn from the container by Venturi action of the flowing carrier liquid, to be replaced by air to avoid container collapse and to otherwise avoid any interference with the smooth operation of the sprayer. And, when the operator rotates the valve to its OFF position of FIG. 5, underside 46 of the handle overhang bears against outer edge 36 of the rocker arm pivoting it downwardly as shown in solid outline in FIG. 7 about pivot pin 45 such that vent plug seal 35 is now in sealing engagement with housing 13 overlying the vent port 32 to seal the vent port closed during conditions of storage, shipping, and non-use to avoid any leakage of product through the vent with the valve in its OFF position. Mounting flanges 38 of the rocker arm facilitate the aforedescribed pivoting movement of the rocker arm between the valve ON and OFF positions without interference.

The vent control according to the invention is fully external to the rotary valve and to the transverse bore of the housing in which the valve is received. The rocker arm is simply snapped in place to the outside of the sprayer housing during assembly permitting it to be pivoted about pin 45 as aforedescribed while being securely mounted in place without the likelihood of dislodgement during outdoor use of the sprayer assembly. The rotary valve, i.e., the underside of an overhang of the turning handle or the like, is arranged as to bear against outer edge 36 of the rocker arm as well as its cam surface at one end to effect vent opening and closing respectively during the ON and OFF positions of the valve on the selected rotary movements thereof. It is to be pointed that, within the scope of the invention, the rocker arm can likewise be arranged such that the cam surface is at the opposite end from that shown while achieving the same rocker arm movements. Also, it is within the purview of the invention that other known equivalents could be substituted for the rocker arm, as well as for the arm cam and the cam follower, so long as such a mechanism is operated by the valve on turning to open and close the vent during valve ON and valve OFF positions, and the vent control is fully external to the rotary valve and its transverse bore. For example, the rocker arm could be arranged for pivoting about an axis perpendicular to that of pin 45. Or, other known approaches within the scope of the invention could be practiced.

Obviously, many other modifications and variations of the present invention are made possible in the light of the above teachings. It is therefore to be understood that within the scope of the appended claims, the invention may be practiced otherwise than as specifically described.

What is claimed is:

1. A hose-end sprayer assembly for connection to a container of liquid product, comprising: a housing having a carrier liquid inlet passage, a liquid product inlet opening and a discharge passage; a rotary valve mounted within a transverse bore of said housing and comprising a liquid duct and a product duct opening into said liquid duct; the rotary valve being selectively rotatable within said transverse bore for interconnecting said carrier liquid inlet passage and said liquid product inlet opening with said discharge passage in a first selective rotative position of the rotary valve; the housing having a means, external to said transverse bore, for defining a vent path between the interior of the container and atmosphere in the first rotative position; and closing means, external to said housing and to said rotary valve, that is pivotable about a member disposed external to said rotary valve in response to rotation of said rotary valve for closing the vent path in a second selective rotative position of the rotary valve wherein the carrier liquid inlet passage is out of communication with the discharge passage; wherein said closing means comprises a movable external vent plug assembly and said rotary valve engages said vent plug assembly for closing the vent path in the second rotative position of the valve.

2. The sprayer assembly according to claim 1, wherein said means for defining said vent path comprises a vent port.

3. The sprayer assembly according to claim 1, wherein said vent plug assembly comprises a vent plug seal movable with the vent plug assembly into and out of the vent path.

4. The sprayer assembly according to claim 1, wherein the vent plug assembly includes a rocker arm having a vent plug seal, the rocker arm being pivotally mounted to the housing for movement of the vent plug seal into the vent path in the second rotative position.

5. The sprayer assembly according to claim 1, wherein said closing means comprises a rocker arm pivotally mounted to the housing, the rotary valve engaging the rocker arm for moving a vent plug seal on the arm into and out of the vent path respectively in the second and first rotative positions of the rotary valve.

6. The sprayer assembly according to claim 5, wherein said means for defining said vent path comprises a vent port which is opened and closed upon pivoted movement of the rocker arm.

7. The sprayer assembly according to claim 1, wherein the rotary valve has a handle for rotation thereof, the closing means comprising a vent plug assembly pivotally mounted externally to the housing, the handle of the rotary valve engaging the vent plug assembly for pivoting the vent plug assembly into and out of the vent path respectively in the second and first rotative positions of the rotary valve.

8. The sprayer assembly according to claim 7, wherein the vent plug assembly includes a rocker arm and a vent plug seal, the handle of the rotary valve engaging the rocker arm for pivoting the rocker arm and moving the vent plug seal into and out of the vent path.

9. The sprayer assembly according to claim 2, wherein said closing means comprises a rocker arm pivotally mounted externally to the housing, an extension on the rotary valve engaging the rocker arm for movement of a vent plug seal on the rocker arm into and out of the vent port respectively in the second and first rotative positions of the rotary valve.

10. The sprayer assembly according to claim 1, wherein the member comprises a radially extending portion of the housing that interfaces to said closing means to provide for the pivotal movement thereof.

11. The sprayer assembly according to claim 5, wherein the vent plug seal is located near one end of the rocker arm, and cam means is located near an opposite end of the rocker arm for engagement by the rotary valve in the first rotative position thereof.

12. The sprayer assembly according to claim 5, wherein the housing has a radially extending pivot pin engaged by the rocker arm to facilitate pivotal movement thereof.

13. The sprayer assembly according to claim 12, wherein the rocker arm is movably mounted to the housing on the pivot pin to facilitate the pivotal movement thereof.

14. A sprayer assembly for connection to a container of liquid chemical to be sprayed, comprising: a housing having a carrier liquid inlet passage, a chemical liquid inlet passage and a discharge passage; a rotary valve mounted within said housing having a carrier liquid duct and a product duct opening into said carrier liquid duct; said rotary valve being selectively rotatable about a rotational axis to an ON position in which the carrier liquid inlet passage is connected with said chemical liquid inlet passage, and the rotary valve being selectively rotatable about the rotational axis to an OFF position in which the carrier liquid inlet passage is not connected with said chemical liquid inlet passage; the housing having a vent port for communication with the container; vent control means, mounted externally on the housing, for pivoting movement about a member offset from the rotational axis of the rotary valve in response to rotation of the rotary valve to close the vent port in the OFF position and to open the vent port in the ON position; wherein said vent control means comprises a rocker arm having a vent plug for opening and closing the vent port.

15. The sprayer assembly according to claim 14, wherein said vent control means comprises a vent plug assembly having a vent plug for opening and closing the vent port.

16. The sprayer assembly according to claim 14, wherein said rocker arm has a cam surface engageable by the rotary valve to effect rocker arm pivoting movement.

17. The sprayer assembly according to claim 14, wherein the rotary valve has a turning handle in engagement with the vent control means to effect pivoting movement thereof upon valve rotation.

18. The sprayer assembly according to claim 16, wherein the rotary valve has a turning handle in engagement with the cam surface to effect pivoting movement of the rocker arm.

19. The sprayer assembly according to claim 14, wherein the rotary valve has an external protrusion which engages the vent control means to effect the pivoting movement thereof.

20. The sprayer assembly according to claim 14, wherein the rotary valve has an external protrusion which engages the rocker arm to effect the pivoting movement thereof.

21. The sprayer assembly according to claim 16, wherein the rotary valve has means defining a cam follower in engagement with said cam surface for moving the rocker arm to the vent open position.

22. The sprayer assembly assembly according to claim 16, wherein the member comprises a radially extending portion of the housing that interfaces to the rocker arm to provide for the pivotal movement thereof.

23. The sprayer assembly according to claim 22, wherein the member comprises a pivot pin engaged by the rocker arm to facilitate pivotal movement thereof.

* * * * *